US011733001B1

(12) United States Patent
Eberhardt

(10) Patent No.: US 11,733,001 B1
(45) Date of Patent: Aug. 22, 2023

(54) BORESIGHTING MECHANISM

(71) Applicant: LOCKHEED MARTIN CORPORATION, Bethesda, MD (US)

(72) Inventor: Alex Eberhardt, Seymour, CT (US)

(73) Assignee: LOCKHEED MARTIN CORPORATION, Bethesda, MD (US)

( * ) Notice: Subject to any disclaimer, the term of this patent is extended or adjusted under 35 U.S.C. 154(b) by 0 days.

(21) Appl. No.: 17/748,773

(22) Filed: May 19, 2022

(51) Int. Cl.
*F41G 3/22* (2006.01)
*F41G 1/54* (2006.01)
*F41G 3/14* (2006.01)

(52) U.S. Cl.
CPC ..... *F41G 3/22* (2013.01); *F41G 1/545* (2013.01); *F41G 3/142* (2013.01)

(58) Field of Classification Search
CPC ..... F41G 3/22; F41G 3/142; F41G 1/545
USPC ..... 89/37.16
See application file for complete search history.

(56) References Cited

U.S. PATENT DOCUMENTS

2 A * 7/1836 Goulding ..... D01G 21/00 57/58.49
3,816,000 A * 6/1974 Fiedler ..... G02B 23/14 356/139.05
4,162,646 A 7/1979 Henderson, Jr.
4,534,116 A * 8/1985 Davis ..... F41G 1/54 279/2.03
5,282,589 A * 2/1994 Branigan ..... G01S 17/933 342/63
6,250,197 B1 * 6/2001 Sanderson ..... F41A 23/20 89/37.16
2007/0199227 A1 * 8/2007 Ertl ..... F41G 1/10 42/137
2013/0133239 A1 * 5/2013 Bowman ..... F41G 1/393 42/115
2018/0011278 A1 * 1/2018 Po ..... G02B 7/04
2022/0065585 A1 * 3/2022 Morgan ..... F41G 1/545

* cited by examiner

*Primary Examiner* — Samir Abdosh
(74) *Attorney, Agent, or Firm* — Foley & Lardner LLP

(57) ABSTRACT

A boresighting mechanism for adjusting an armament of an aircraft. The mechanism includes a housing comprising a proximal end, a distal end, and an inner cavity. The mechanism further includes a jackscrew with a threaded portion disposed in the inner cavity and an unthreaded portion extending from the proximal end of the housing. The mechanism further includes a follower threadedly coupled to the jackscrew at a first end within the inner cavity and extending from the distal end of the housing. The follower is configured to be coupled to an adjustment feature of the armament at a second end. The mechanism further includes an adjustment knob coupled to the unthreaded portion of the jackscrew and configured to rotate the jackscrew to thereby cause linear motion of the follower. The linear motion allows for adjustment of the armament via the adjustment feature.

20 Claims, 10 Drawing Sheets

BORESIGHTING MECHANISM

STATEMENT REGARDING FEDERALLY SPONSORED RESEARCH OR DEVELOPMENT

This invention was made with Government support under Agreement No. W911W6-20-F-0009, awarded by the Army Contracting Command-Redstone Arsenal. The Government has certain rights in the invention.

BACKGROUND

The present invention relates generally to the field of boresighting armaments for aircraft. Boresighting refers to the technique of aiming the armament so that its point of aim is aligned with the aircraft targeting system. This process is especially important on rotary wing aircraft, such as helicopters, to prevent ammunition from contacting aircraft components such as refueling probes.

SUMMARY OF THE INVENTION

In an exemplary aspect, a boresighting mechanism for adjusting an armament of an aircraft is provided. The mechanism includes a housing comprising a proximal end, a distal end, and an inner cavity. The mechanism further includes a jackscrew with a threaded portion disposed in the inner cavity and an unthreaded portion extending from the proximal end of the housing. The mechanism further includes a follower threadedly coupled to the jackscrew at a first end within the inner cavity and extending from the distal end of the housing. The follower is configured to be coupled to an adjustment feature of the armament at a second end. The mechanism further includes an adjustment knob coupled to the unthreaded portion of the jackscrew and configured to rotate the jackscrew to thereby cause linear motion of the follower. The linear motion allows for adjustment of the armament via the adjustment feature.

In a further exemplary aspect, an aircraft is provided including an armament rotatably coupled to a surface of a portion of the aircraft and configured to rotate about an axis of rotation and a mechanism configured to rotate the armament about the axis of rotation. The mechanism includes a jackscrew comprising a threaded portion. The threaded portion is threadedly coupled to a follower. The mechanism further includes a handle configured to be operated manually. The handle is coupled to and configured to rotate the jackscrew. The mechanism further includes an adapter coupled to the follower and the armament. Rotation of the jackscrew causes linear motion of the follower and the adapter, the linear motion of the adapter causing the rotation of the armament about the axis of rotation.

In yet a further exemplary aspect, a method of boresighting an armament using an adjustment mechanism is provided. The mechanism includes a handle coupled to a jackscrew disposed within a housing. Rotation of the handle causes the jackscrew to adjust a firing angle of the armament. The handle and the housing include complementary knurls. The method includes pulling the handle to disengage the knurls of the handle from the knurls of the housing, rotating the handle to adjust the firing angle of the armament, and releasing the handle to reengage the knurls of the handle with the knurls of the housing.

These and further exemplary aspects are described in further detail below.

BRIEF DESCRIPTION OF THE DRAWINGS

The disclosure will become more fully understood from the following detailed description, taken in conjunction with the accompanying Figures, wherein like reference numerals refer to like elements unless otherwise indicated, in which.

It will be recognized that the Figures are the schematic representations for purposes of illustration. The Figures are provided for the purpose of illustrating one or more implementations with the explicit understanding that the Figures will not be used to limit the scope of the meaning of the claims.

DETAILED DESCRIPTION

Boresighting requires fine mechanical adjustment of the firing angle of an armament. Boresighting is typically accomplished with a mechanical device such as a threaded rod. Once the armament is in position, a mechanism such as a jam nut may be used to hold the setting in place. A secondary locking system, such as a safety wire, is also typically employed. This method of adjustment requires the use of tools that may be difficult to use and may not always be available, especially mid-flight. Rotary wing aircraft are loaded differently on the ground, where they sit on skids, than they are in flight, where they are supported by the rotor system. Accordingly, a rotary wing aircraft that is properly boresighted on the ground may not be properly boresighted in flight.

Further, tightening of the jam nut tends to cause the threaded rod setting to undergo displacement. The tightening may result in slight movement of the threaded rod. Aircraft vibrations can also cause slight variations in the threaded rod setting. Because ammunition is fired a long distance, a threaded rod that is slightly out of place may have significant impact on the trajectory of the ammunition. If the impact is significant enough, the armaments may need to be boresighted again. An armament out of alignment can reduce the accuracy of the armament and may pose a safety hazard.

The exemplary non-limiting embodiments described herein relate to a boresighting mechanism that does not require tools and reliably locks the armament in place without the need for a locknut or safety wire. Because tools that may not be available on the aircraft are not required, the embodiments further allow for mid-air boresighting.

Figure 1A:
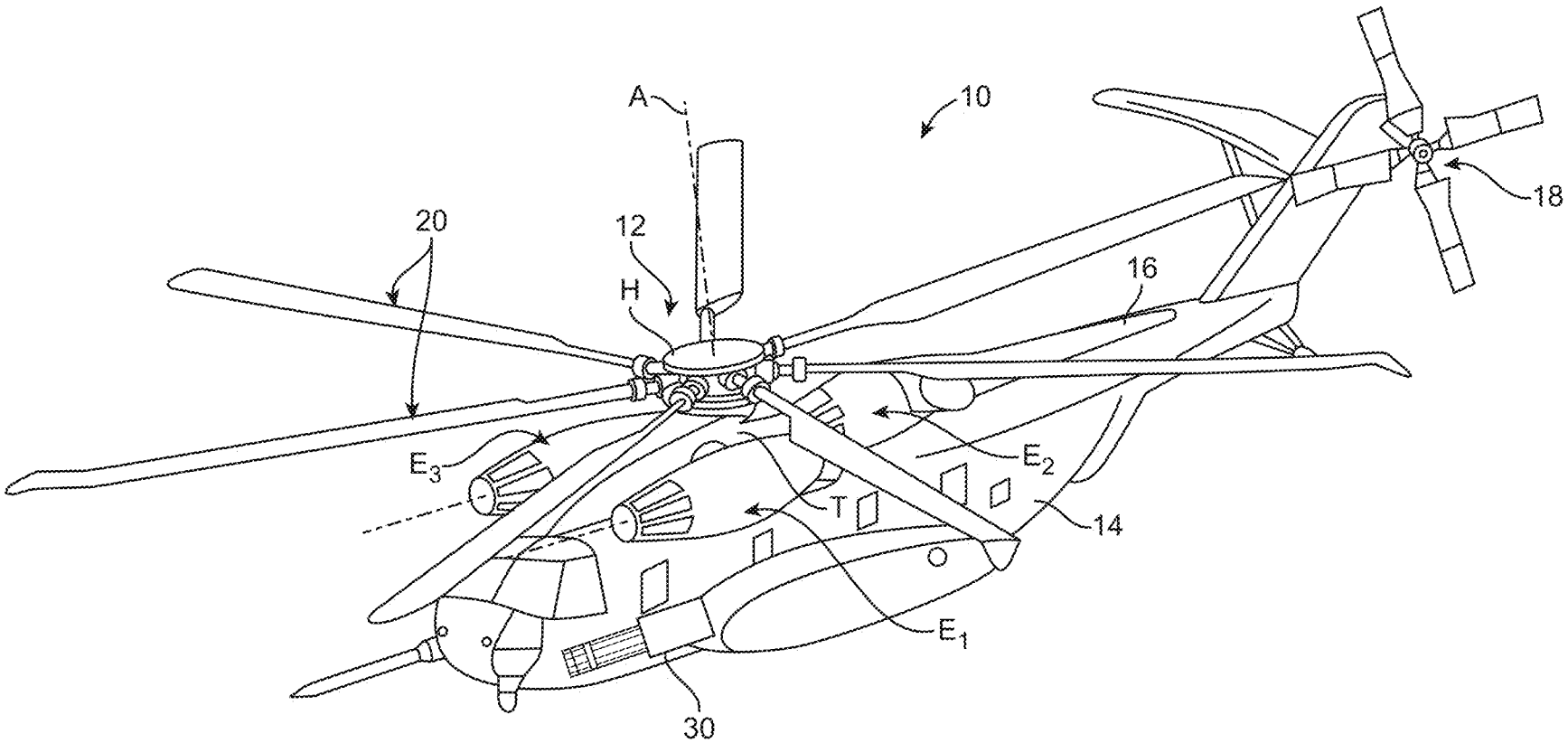
FIG. 1A is a perspective view of a rotary wing aircraft including armaments.

Referring to FIG. 1A, an example of a vertical takeoff and landing (VTOL) rotary-wing aircraft 10 having a main rotor system 12, such as a helicopter, is illustrated. As shown, the aircraft 10 includes an airframe 14 having an extending tail 16, which mounts a tail rotor system 18, such as an antitorque system. The main rotor system 12 is driven about an axis of rotation A via a main gearbox, illustrated schematically at T, by one or more engines, illustrated at E1-E3. The main rotor system 12 includes a plurality of rotor blade assemblies 20 mounted to a rotor hub assembly H. The aircraft 10 may include one or more armaments 30 (e.g., guns, artillery) configured to fire projectiles. The armaments 30 may be fixed-forward armaments that are not actively controlled, but fire in a fixed direction relative to the direction that the aircraft 10 is facing, once they are set in position. Although a particular helicopter configuration is illustrated and described herein, other configurations and/or aircraft may be utilized in connection with the concepts described herein, including fixed-wing aircraft. For example, the techniques according to the present disclosure may be implemented in a variety of aircraft, including a high speed compound rotary wing aircraft with supplemental translational thrust systems, a dual contra-rotating, coaxial rotor system aircraft, a turbo-prop aircraft, a tilt-rotor aircraft and a tilt-wing aircraft.

Figure 1B:
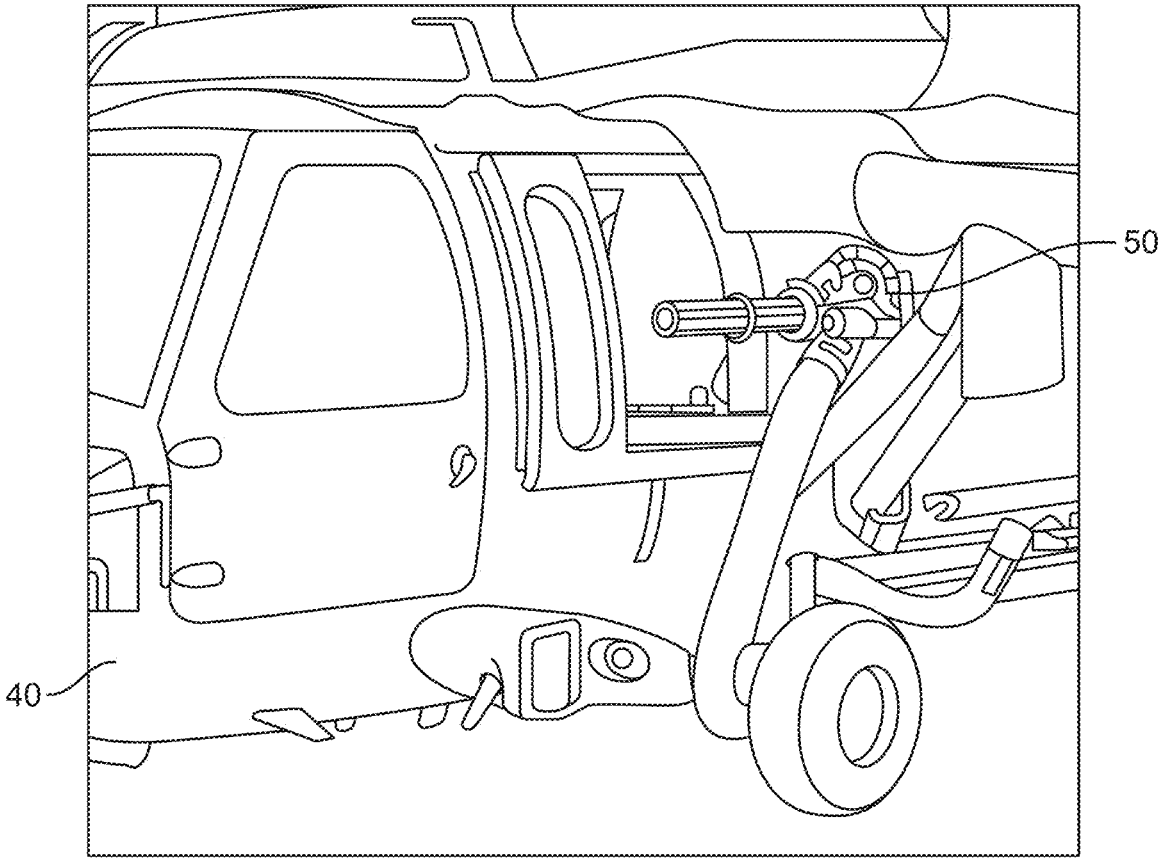
FIG. 1B is a perspective view of a rotary wing aircraft including armaments.
Figure 1C:
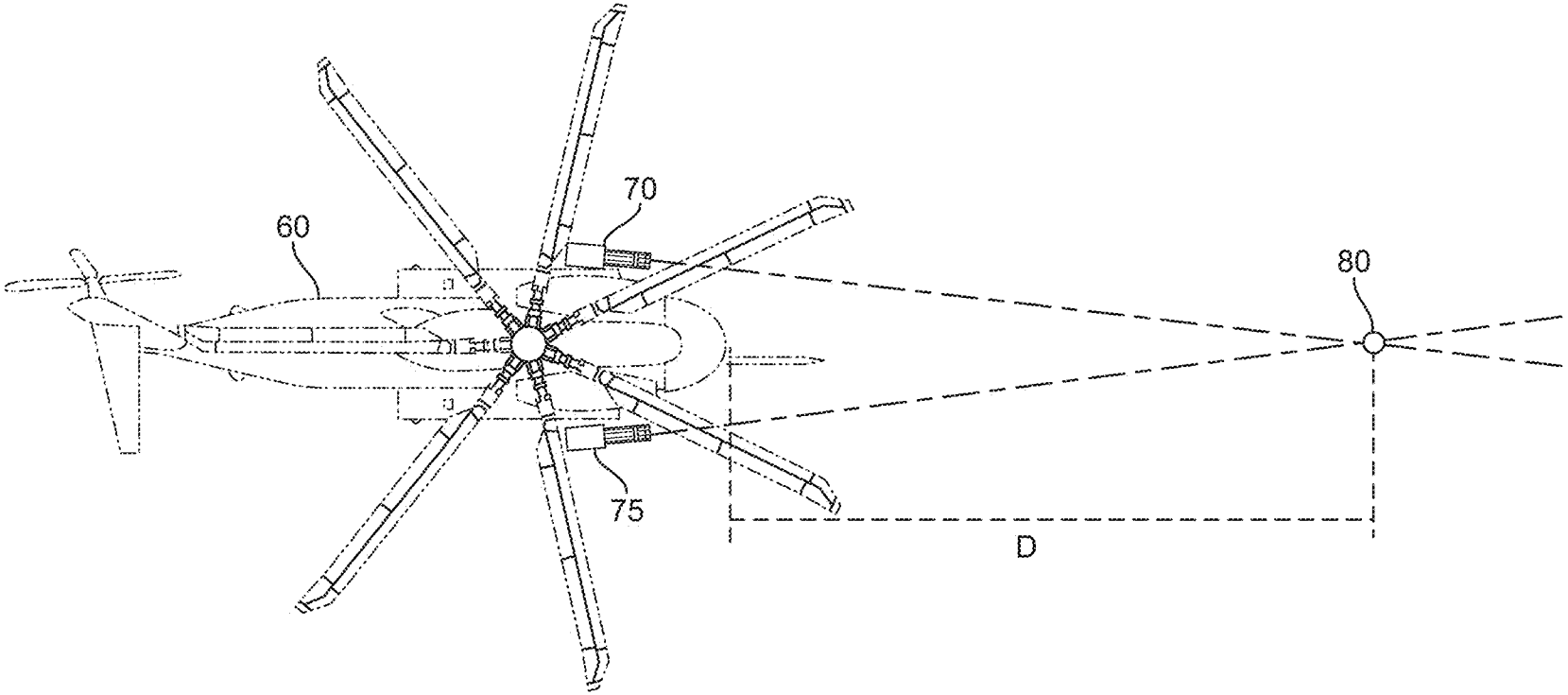
FIG. 1C is a plan view of a rotary wing aircraft including armaments.

FIG. 1B illustrates a rotary wing aircraft 40 with an armament 50, according to another exemplary embodiment. FIG. 1C is a plan view of a rotary wing aircraft 60 with two armaments 70, 75, according to another exemplary embodiment. The armaments 70, 75 are boresighted such that the ammunition fired from the armaments 70, 75 converge at a point 80 at a preferred distance D from the aircraft 60. A small deviation in the azimuth angle of the armaments 70, 75 may affect the trajectory of ammunition so as to cause point 80 to deviate from a distance D. This may impede or hinder successful targeting of the armaments 70, 75. Similar problems may arise if the elevation angles of the armaments are not set appropriately. Accordingly, precise mechanisms for setting and holding the elevation and azimuth angles of the armaments 70, 75 relative to the aircraft 60 are desirable.

Referring generally to FIGS. 2-6, a tool-less boresighting mechanism 200 is shown, according to an exemplary embodiment. The mechanism 200 may be mounted to an aircraft component and may interface with an adjustment feature of an armament. To make adjustments, a user pulls the handle 212 (e.g., adjustment knob) back to disengage a knurled surface of the handle 212 from a matching (complementary) knurled surface in a handle receiver portion 240 of the inner cavity 234 of the main body housing 204. The user may then rotate the handle 212, which rotates a jackscrew 266 in the inner cavity 234. The jackscrew 266 includes a threaded portion 288 that is threadedly coupled to a corresponding threaded portion 231 of a ram 214 (e.g., a follower, etc.). For example, the jackscrew 266 may include a male threaded portion that threads into a female threaded portion of the ram 214. Rotation of the jackscrew 266 causes the ram 214 to move in a longitudinal, linear direction of the housing 204. The mechanism may include an adapter 216 coupled to a portion of the ram 214 that extends out of the inner cavity 234. The adapter 216 may interface with the adjustment feature of the armament to adjust and boresight the armament. When adjustment is complete, the user releases the handle 212 and a spring may push the handle forward, causing the knurled surface of the handle to reengage the knurled surface of the housing 204. Once the handle reengages the housing 204, the rotation of the handle 212 and jackscrew 266 is restricted by the knurls and the ram 214 is locked in place by the threaded portion of the jackscrew 266. The handle 212, and the mechanism 200 as a whole, are configured to be operated by hand, without the use of tools. Hence, the mechanism 200 serves as a tool-less boresighting mechanism that can be readily utilized.

Figure 2:
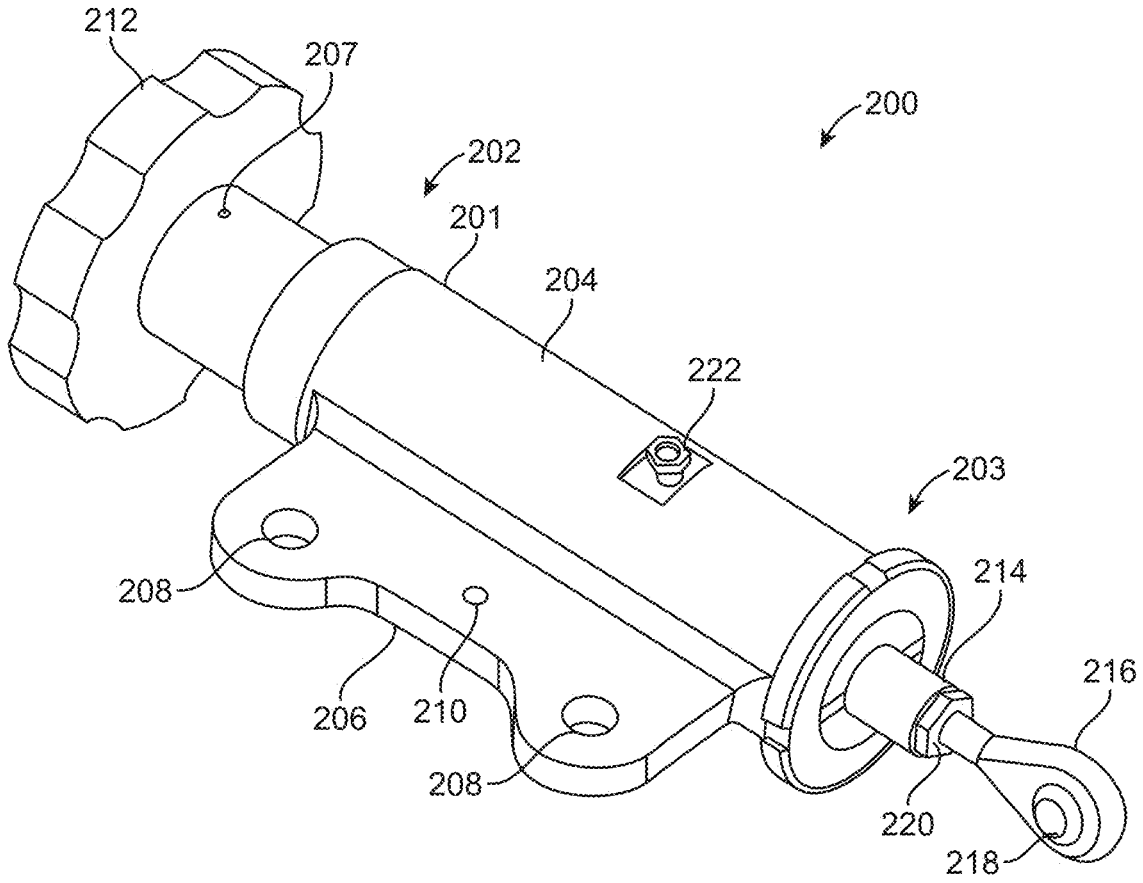
FIG. 2 is a perspective view of a boresighting mechanism, according to an exemplary embodiment.

FIG. 2 shows a perspective view of a tool-less boresighting mechanism 200, according to an exemplary embodiment. The mechanism 200 includes a main body 201 that may include the housing 204 and a flange 206. The flange may include one or more fastener holes 208 for fastening the mechanism 200 to a component (e.g., a mounting surface) of the aircraft 100 and one or more pin holes 210 for positioning the mechanism 200. For example, a component of the aircraft 100 may include holes that align with the fastener holes 208 and a fastener (e.g., a screw, a bolt, etc.) may be extend through the holes to fasten the mechanism 200 to the component of the aircraft 100.

In some embodiments, the mechanism 200 may be configured to retrofit an aircraft by replacing an existing boresighting mechanism. The housing 204 may be designed to adaptably mount to a surface that was not originally designed to employ to the mechanism 200. In other embodiments, the housing may be integrated into a component of the aircraft. For example, a panel or a structural member of the aircraft may be designed with an integrated housing into which the remaining components of the mechanism 200 may be assembled.

The housing 204 includes a handle end 202 (e.g., a first end, a proximal end, etc.) and a tool end 203 (e.g., a second end, a distal end, etc.). The housing 204 houses other components of the mechanism 200, as shown in FIGS. 3-6. The mechanism 200 includes a handle 212 and a ram 214. The ram 214 extends into the housing 204 and out of the tool end 203. Rotation of the handle 212 causes the ram 214 to move farther into or farther out of the housing 204. The ram 214 may be coupled to an adapter 216 that interfaces with the armament to adjust the position of the armament. In the non-limiting example shown in FIG. 2, the adapter 216 is a rod end. However, other adapters are contemplated, including clevis rod ends, eyelet fittings, or plates configured to be fastened to the adjustment feature of the armament. The ram 214 moves the rod end away from or towards the housing 204, thus causing the adjustable component of the armament to move and adjusting the aim of the armament. The mechanism 200 may include a jam nut 220 for locking the adapter 216 to the ram 214. The mechanism 200 may also include a grease fitting 222 (e.g., a grease zerk) for injecting grease into the housing 204.

Figure 3:
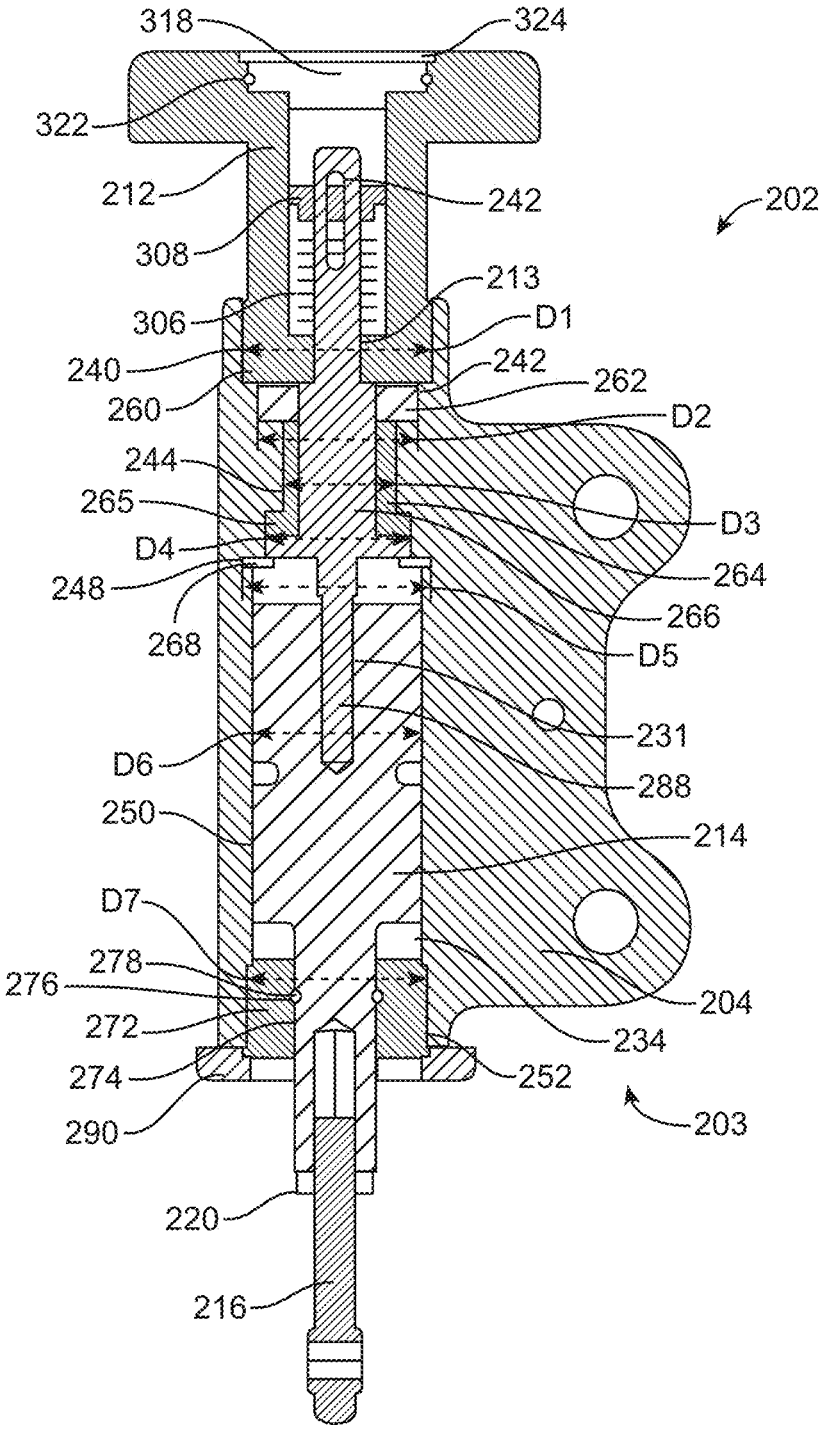
FIG. 3 is a cross-sectional view of the boresighting mechanism of FIG. 2.
Figure 4:
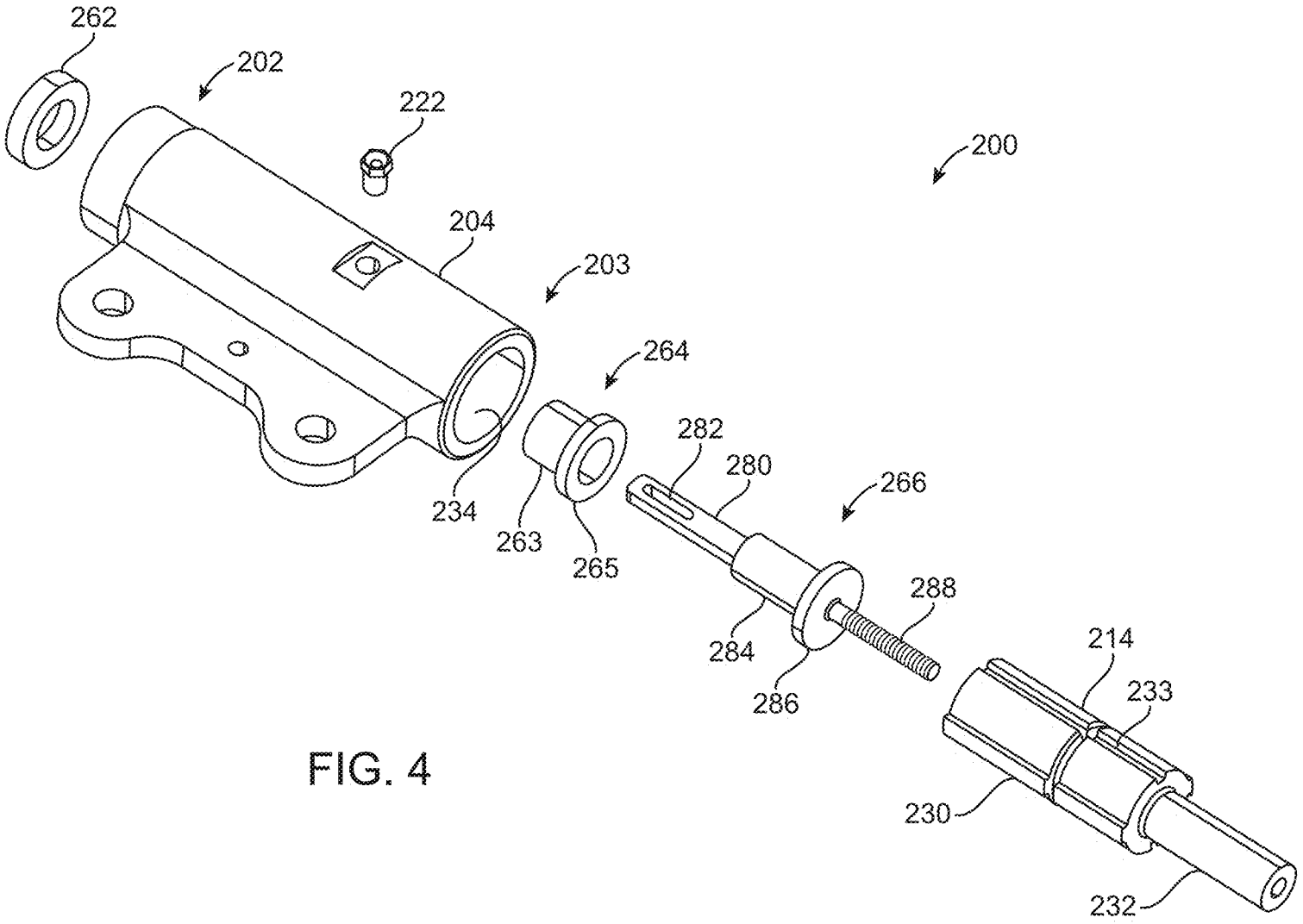
FIG. 4 is a partial perspective exploded view of the boresighting mechanism of FIG. 2.
Figure 5:
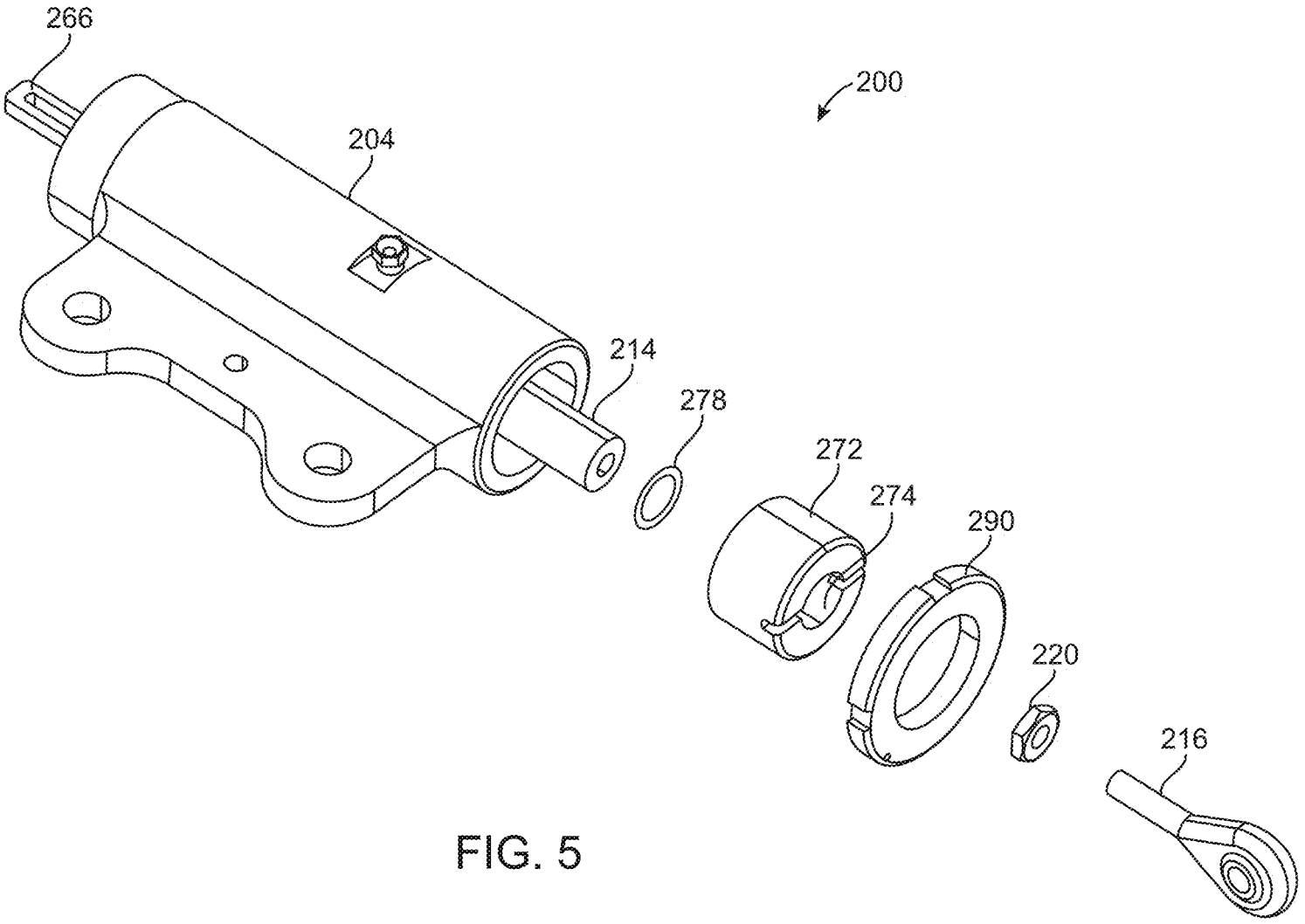
FIG. 5 is a partial perspective exploded view of the boresighting mechanism of FIG. 2.
Figure 6:
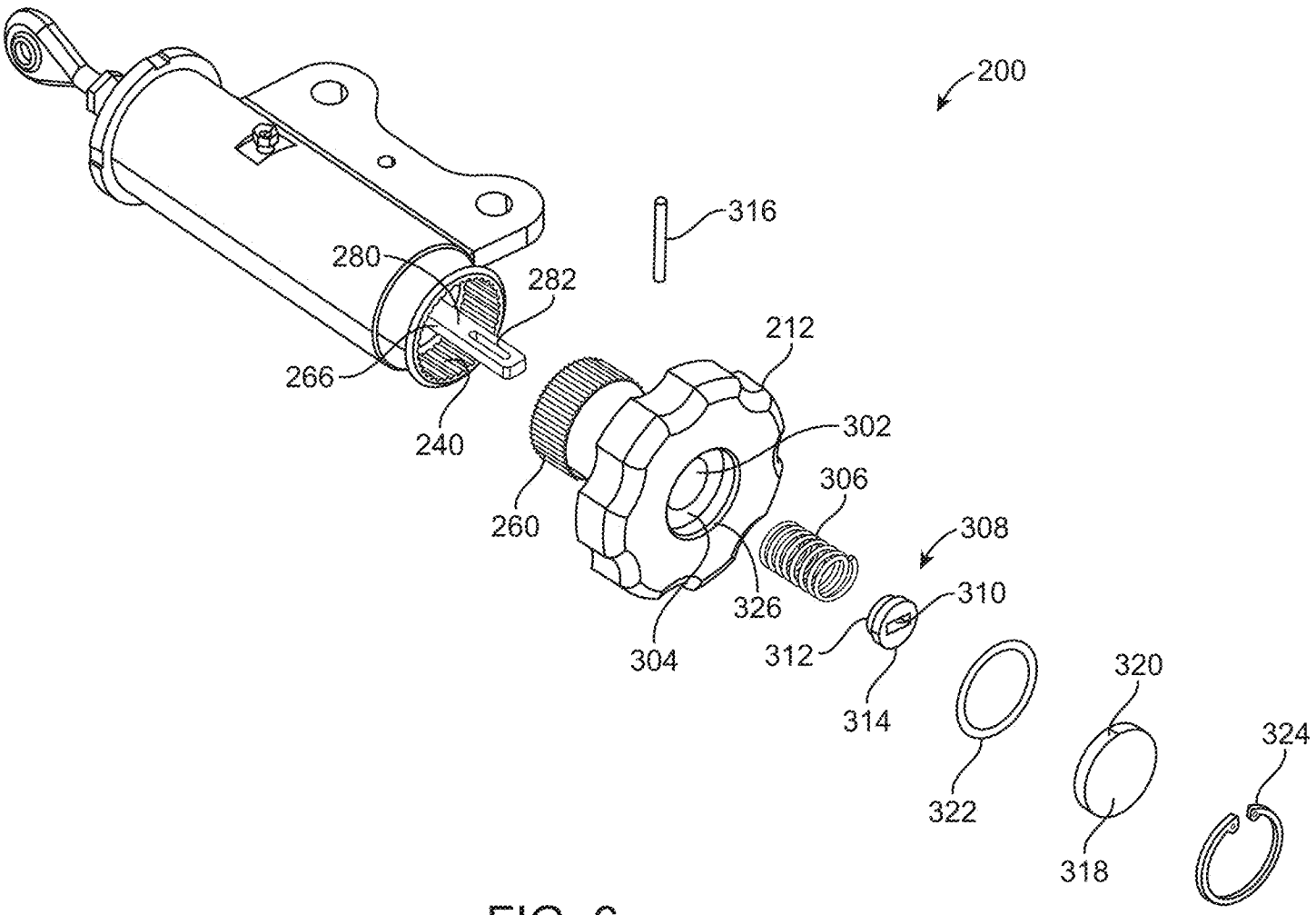
FIG. 6 is a partial perspective exploded view of the boresighting mechanism of FIG. 2.

Referring to FIGS. 3-6, various views of the tool-less boresighting mechanism 200 of FIG. 2 are shown. FIG. 3 shows a cross sectional view of the tool-less boresighting mechanism 200 of FIG. 2. FIGS. 4-6 show perspective views of the tool-less boresighting mechanism 200 of FIG. 2 with some components shown in an exploded view and some components hidden. The housing 204 includes an inner cavity 234. The inner cavity 234 may include a plurality of coaxial cylindrical portions. Beginning at the handle end 202 of the housing 204, the inner cavity includes the handle receiver portion 240 having a first diameter D1. As shown in FIG. 6, the handle receiver portion 240 may include a knurled surface comprising knurls configured to receive and engage the matching (complementary) knurls of the knurled portion 260 of the handle 212. Thus, the knurls of the knurled portion 260 of the handle 212 are disengaged when the armament is being adjusted and reengaged when the armament adjustment is complete.

Moving toward the tool end 203 of the housing 204, the inner cavity 234 may include a seal receiver portion 242 having a second diameter D2 that is smaller than the first diameter D1. The seal receiver portion 242 is configured to receive a seal 262 that fluidly seals the inner cavity 234 from the outside environment in order to keep grease in and debris out of the inner cavity 234. During assembly of the mechanism 200, the seal 262 may be inserted into the seal receiver portion 242 from the proximal end 202 of the housing 204. Next, the inner cavity 234 may include a bearing receiver portion 244 having a third diameter D3 that is smaller than the second diameter D2. The bearing receiver portion 244 may be configured to receive a bearing 264 (e.g., a plane bearing, a sleeve bearing, a flanged bearing, etc.) for reducing the friction in the jackscrew 266 when the jackscrew 266 is rotated. The bearing 264 may include a sleeve 263 and a flange 265. The outer diameter of the sleeve 263 may be approximately equivalent to the third diameter D3, such that the bearing can slide into or be pressed into the bearing receiver portion 244 of the inner cavity 234 via the tool end 203 of the housing 204 when the mechanism 200 is being assembled.

Next, the inner cavity 234 may include a flange receiver portion 246 with a fourth diameter D4 that is larger than the third diameter D3. The flange receiver portion 246 may be configured to receive the flange 265 of the bearing 264 as well as the flange 286 of the jackscrew 266. The flange 265 of the bearing 264 has a larger diameter than diameter D3, so the bearing 264 cannot move beyond the bearing receiver portion 244 in the direction of the proximal end 202 of the housing 204. For example, the flange 265 may rest on the shoulder where the flange receiver portion 246 meets the bearing receiver portion 244, stopping the bearing 264 from moving farther toward the proximal end 202. The flange 265 may have a diameter that is similar to, but smaller than the fourth diameter D4 of the flange receiver portion 246. Similarly, the flange 286 of the jackscrew 266 has a larger diameter than the inner diameter of the bearing 264, so the bearing 264 cannot move beyond the flange 265 of the bearing 264 in the direction of the proximal end 202 of the housing 204.

Next, the inner cavity 234 may include a circlip receiver portion 248 with a fourth diameter D5 that is larger than the fourth diameter D4 and larger than the sixth diameter D6 (described below). The circlip receiver portion 248 is configured to receive a circlip 268 (e.g., retaining ring, internal retaining ring etc.) to hold the jackscrew 266 in place so that it cannot move toward the distal end 203 of the housing 204. During assembly of the mechanism, the circlip 268 is compressed and inserted into the inner cavity 234 via the distal end 203 of the housing 204 and allowed to expand into the circlip receiver portion 248. Because the fifth diameter D5 is larger than the fourth diameter D4 and the sixth diameter D6, and the length of the circlip receiver portion 248 is substantially the same as the thickness of the circlip 268, the circlip 268 is captured within the circlip receiver portion 248 and cannot move toward the proximal or distal ends 202, 203 of the housing 204. Thus, because the flange 286 of the jackscrew 266 is captured between the circlip 268 and the flange 265 of the bearing 264, the jackscrew 266 cannot move in the direction of the distal end 203 or the proximal end 202 of the housing 204. The jackscrew 266 may be inserted into the inner cavity via the distal end 203 when the mechanism 200 is being assembled (e.g., before the circlip 268 is inserted). As shown in FIG. 5, the jackscrew 266 may include a lever portion 280 (e.g., a lever end, an unthreaded end or portion, etc.) including a slot 282, a bearing portion 284, a flange 286, and a screw portion 288 (e.g., a threaded portion, a threaded end etc.).

The lever portion 280 of the jackscrew 266 may have a rectangular cross section and extends into a hole 213 (shown in FIG. 3) in the handle 212 with a similar cross section, such that rotation of the handle 212 causes rotation of the jackscrew 266. As shown in FIG. 6, the hole 213 extends into a circular opening 302 and a counterbore 304. When the mechanism 200 is being assembled, the handle 212 is slid over the lever portion 280. Then, the spring 306 is inserted into the opening 302 such that the spring 306 surrounds the lever portion 280. Next, a spring keeper 308 inserted into the opening 302. The spring keeper 308 includes a slot 310 with a similar cross section to the lever portion 280, and the spring keeper 308 can be slid over the lever portion 280. The spring keeper 308 includes a first portion 312 with a smaller diameter than the inside diameter of the spring 306 and a second portion 314 with a larger diameter than the inside diameter of the spring. The spring is centered on the first portion 312 and is compressed against the second portion 314 when the handle 212 is pulled out from the housing 204 when the mechanism 200 is in use. Next, a pin 316 is inserted into a hole 207 (shown in FIG. 2) in the handle and into the slot 282 of the lever portion 280. After the pin 316 is inserted, the spring 306 presses the spring keeper 308 until the spring keeper 308 contacts the pin 316 and the pin contacts the end of the slot 282. The pin 316 may have a length that is similar to the diameter of the opening 302, such that the pin 316 remains in place between the spring keeper 308 and the slot 282. When the mechanism 200 is in use, the spring 306 is configured to cause the knurls of the knurled portion 260 of the handle 212 to engage the knurls of the handle receiver portion 240 when the handle is not actively being held away from the housing 204 (e.g., when the handle is not caused to be spaced from the housing 204). That is, the knurls of the knurled portion 260 and handle receiver portion 240 are engaged when the handle is not maintained apart from housing 204 and is instead proximate the housing 204. The spring 306 pushes against the spring keeper 308 and the pin 316 to push the handle 212 towards the housing 204.

A cover 318 may also be coupled to the handle 212 to fluidly seal the opening 302 from the outside environment to keep debris out of the opening 302. The cover 318 may include a slot 320 configured to receive an O-ring 322. The cover 318 and O-ring 322 are inserted into the counterbore 304 to fluidly seal the opening 302. Then, a circlip 324 (e.g., a retaining ring, internal retaining ring, etc.) may be inserted into a slot 326 in the counterbore 304 to hold the cover 318 in place.

The bearing portion 284 of the jackscrew 266 may have a circular cross section with a diameter that is slightly smaller than the inner diameter of the bearing 264, such that the bearing portion 284 can be received by the bearing 264. The flange 286 of the jackscrew 266 may rest on the flange 265 of the bearing 264, stopping the jackscrew 266 from moving farther toward the proximal end 202. Thus, when the jackscrew 266 is rotated, the bearing portion 284 may be in sliding contact with the inner surface of the bearing 264 and the flange 286 of the jackscrew 266 may be in sliding contact with the flange 265 of the bearing 264.

Referring again to FIG. 3, moving further toward the distal end 203 of the housing 204, the inner cavity 234 includes a ram receiver portion 250 having a sixth diameter D6 that is smaller than the fifth diameter D5. The ram receiver portion 250 is configured to receive the ram 214. The ram 214 may include a first portion 230 and a second portion 232. The first and second portions 230, 232 may each be cylindrical in shape, with the first portion 230 having a larger diameter than the second portion 232. The first portion 230 is disposed within the inner cavity 234 of the housing 204 and may include grease channels 233 to allow grease to be distributed into the inner cavity 234. The second portion 232 of the ram 214 extends from the inner cavity 234 and out of the distal end 203 of the housing 204. The screw portion 288 of the jackscrew 266 is threaded. For example, the screw portion 288 may comprise acme threads. The screw portion 288 threads into a threaded portion 231 (shown in FIG. 3) of the first portion 230 of the ram 214. When the mechanism 200 is in use, the ram 214 is configured to be coupled to a control feature of an armament, for example, via the adapter 216, which restricts the rotation of the ram 214. Because the jackscrew 266 is prevented from movement in the direction of the proximal or distal ends 202, 203 of the housing 204 and the ram 214 is unable to rotate, rotation of the jackscrew 266 causes the ram 214 to move laterally in the direction of the proximal or distal ends 202, 203 of the housing 204. More particularly, the rotation of the jackscrew 266 causes the ram 214 to move laterally as the screw portion 288 of the jackscrew 266 engages the threaded portion 231 of the ram 214.

Referring once more to FIG. 3, closest to the distal end 203, the inner cavity 234 may include a cap receiver portion 252 having a seventh diameter D7 that is larger than the sixth diameter D6. The cap receiver portion 252 is configured to receive an end cap 272. The cap receiver portion 252 may be threaded such that the end cap 272 may be threaded into the cap receiver portion 252 and coupled to the housing 204. When the cap receiver portion 252 is threaded, the seventh diameter D7 may be the minor diameter of the threads. In some embodiments, the end cap 272 may be press fit into the housing or may be coupled to the housing 204 by fasteners. The end cap 272 includes an opening 274 configured to receive the second portion 232 of the ram 214. The opening 274 may have a diameter that is slightly larger than the diameter of the second portion 232 of the ram 214 and acts as a bearing surface in sliding contact with the second portion 232 when the ram 214 moves laterally in the direction of the proximal or distal ends 202, 203 of the housing 204. The opening 274 may include a groove 276 configured to receive an O-ring 278. The O-ring 278 is configured to fluidly seal the inner cavity 234 from the outside environment in order to retain grease and limit ingress of debris in the inner cavity 234. When the end cap 272 is threaded, a portion of the end cap 272 may extend beyond the distal end 203 of the housing 204. A lock ring 290 (e.g., a locknut) may be coupled (e.g., threaded) to the portion extending beyond the distal end 203 of the housing 204 to lock the end cap 272 in place.

Figure 7:
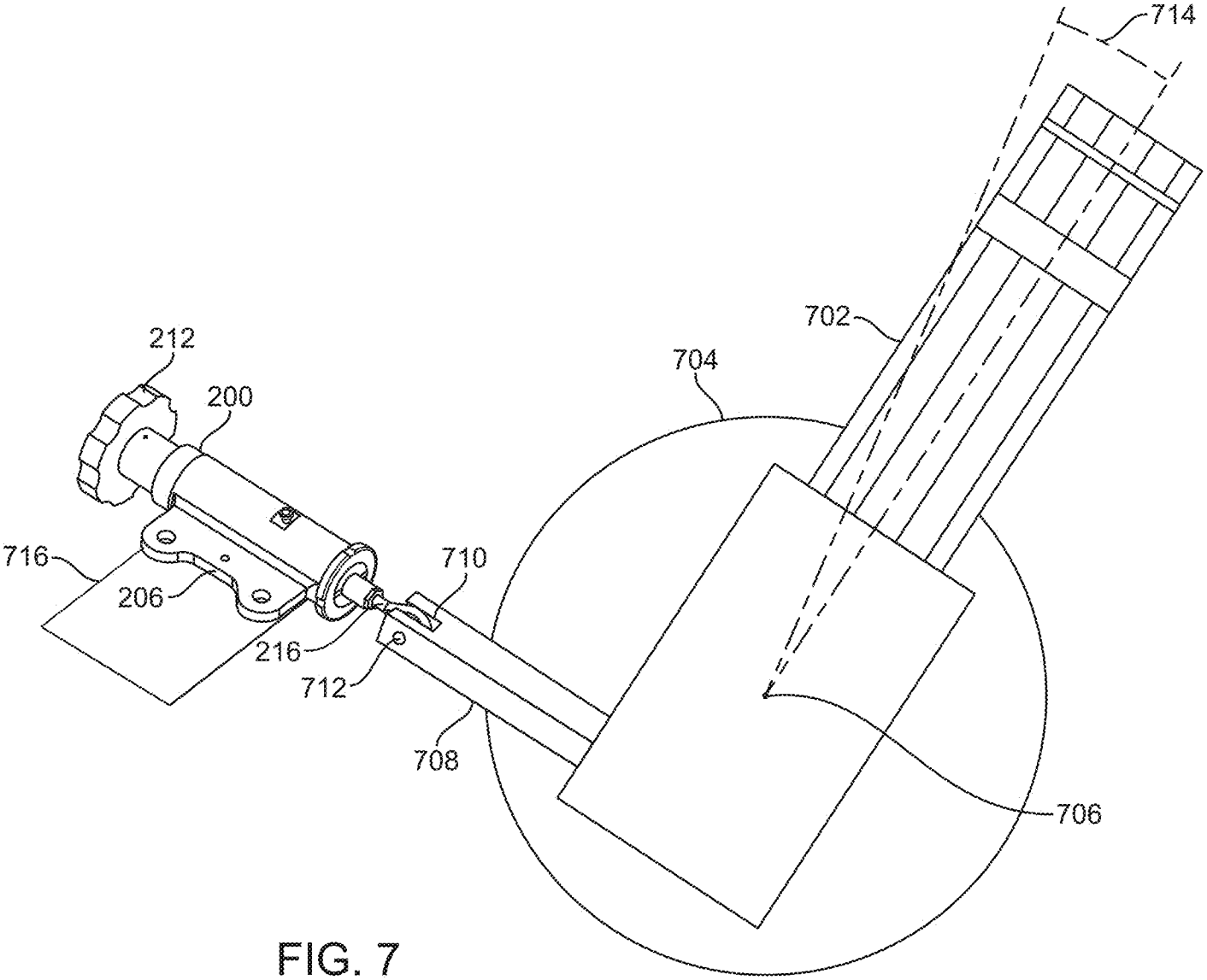
FIG. 7 is a perspective view of the boresighting mechanism of FIG. 2 in use.

Referring now to FIG. 7, the mechanism 200 of FIG. 2 is shown in use, according to an exemplary embodiment. The mechanism 200 may be mounted to a fixed surface 716 of an aircraft (e.g., a surface of a portion of the aircraft) using the flange 206 or may be integrated into a component of the aircraft. An armament 702 is rotatably coupled to a surface 704 (e.g., a surface of a portion of the aircraft) about an axis of rotation 706. The armament 702 is coupled to an adjustment feature 708, which is coupled to the mechanism 200. The adjustment feature 708 may be, for example, an arm extending from the body of the armament 702, or a pin or fastener configured to receive an adapter 216 of the mechanism 200. The adjustment feature may include a clevis 710 that may be positioned on either side of the rod end 216 of the mechanism 200. The clevis 710 may include a hole 712 configured to align with the eyelet 218 of the rod end 216. A fastener may be inserted into the hole 712 and the eyelet 218 to couple the rod end 216 to the adjustment feature 708.

Rotation of the handle 212 causes the jackscrew 266 to push or pull the ram 214 and the rod end 216, which in turn pushes or pulls the adjustment feature 708. The force on the adjustment feature 708 causes the armament 702 to rotate about the axis of rotation 706, allowing fine adjustment of the firing angle 714 of the armament 702. In some embodiments, the rod end 216 may be oriented such that the axis of the eyelet 718 is parallel to the axis of rotation 706 of the armament 702 to allow the adjustment feature 708 to rotate relative to the mechanism 200. The rod end 216 may alternatively be a ball joint rod end to allow the adjustment feature 708 to rotate relative to the mechanism 200. As another alternative, the adjustment feature 708 may be hingedly coupled to the armament 702 such that the adjustment feature 708 may rotate relative to the armament 702. The armament 702 may be coupled to two of the mechanisms 200, namely, a first mechanism (adjuster) to adjust the azimuth angle of the armament 702 and a second mechanism (adjuster) to adjust the elevation angle of the armament 702. The firing angle 714 may refer to the azimuth angle or the elevation angle.

Figure 8:
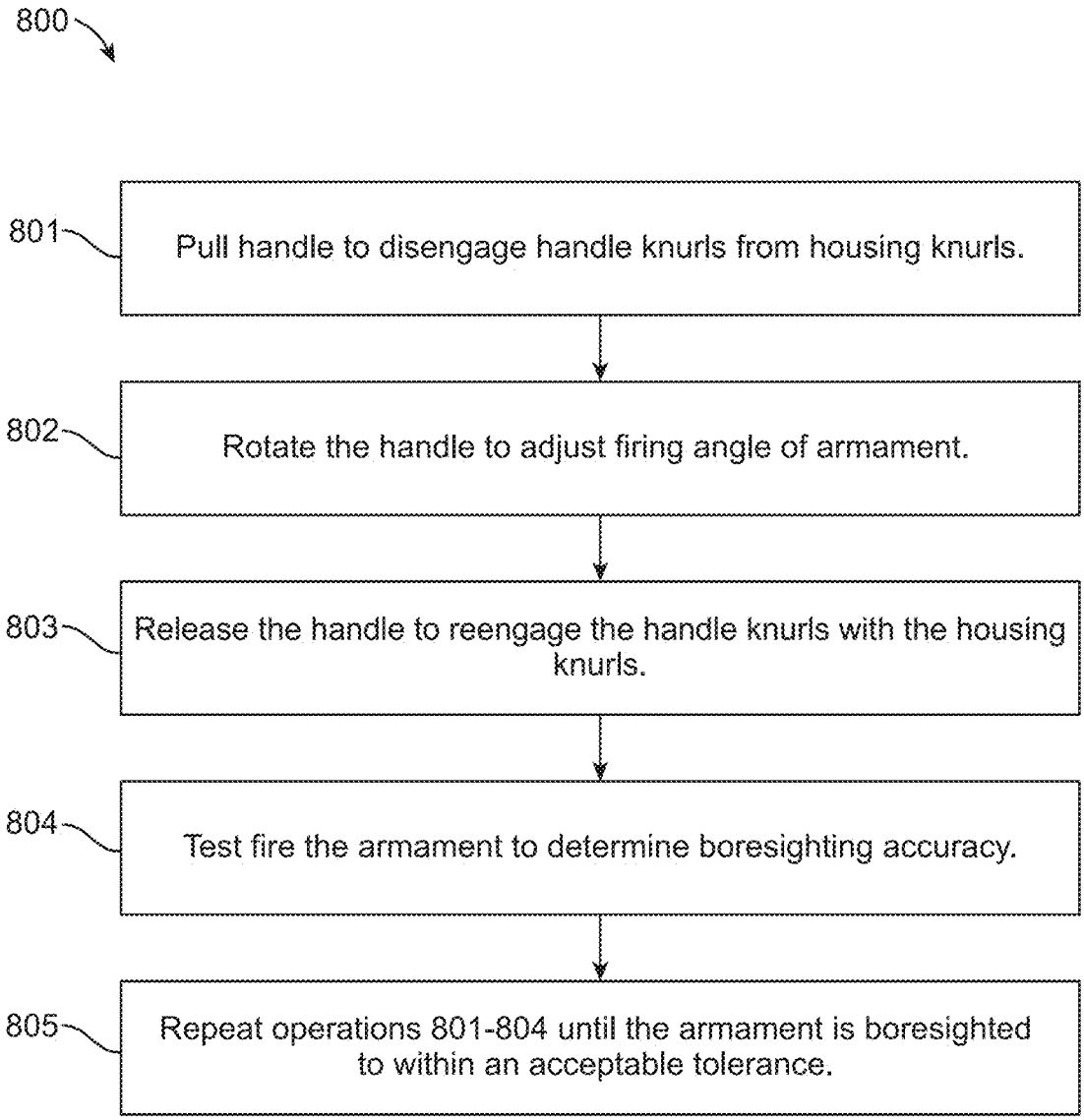
FIG. 8 is a flowchart illustrating a process for using a boresighting mechanism, according to an exemplary embodiment.

Referring now to FIG. 8, a process 800 (e.g., a method) is shown for using a boresighting mechanism (e.g., mechanism 200), according to an exemplary embodiment. The process begins with operation 801. The handle 212 is pulled away from the housing 204 until the knurls of the knurled portion 260 of the handle 212 are disengaged from the knurls of the handle receiver portion 240 of the housing 204. At operation 802, the handle 212 is rotated. The rotation of the handle 212 causes the rotation of the jackscrew 266, causing the ram 214 to push or pull the adjustment feature of the armament to adjust the firing angle of the armament. Once the firing angle has been adjusted to a desired position, the handle is released at operation 803. The spring 306 pushes the handle 212 back towards the housing 204 and the knurls of the knurled portion 260 of the handle 212 reengage the knurls of the handle receiver portion 240 of the housing 204. When the knurls are engaged, the handle 212 and jackscrew 266 are prevented from rotation. Consequentially, the ram 214 is prevented from moving, and the armament is locked into the set firing angle. At operation 804, the armament is test fired to determine the accuracy of the boresighting of the armament. For example, the accuracy of the boresighting may be determined by firing the armament with the aircraft targeting system aimed a target and measuring the distance from the center of the target to the point of impact of the ammunition. At operation, 805, if it is determined that the accuracy of the boresighting is outside an acceptable tolerance range (e.g., a predetermined or predefined range), operations 801-804 may be repeated as necessary until the accuracy in within the acceptable tolerance range. The process 800 may be performed entirely by hand (i.e., manually), without the use of any tool.

While this specification contains specific implementation details, these should not be construed as limitations on the scope of what may be claimed but rather as descriptions of features specific to particular implementations. Certain features described in this specification in the context of separate implementations can also be implemented in combination in a single implementation. Conversely, various features described in the context of a single implementation can also be implemented in multiple implementations separately or in any suitable subcombination. Moreover, although features may be described as acting in certain combinations and even initially claimed as such, one or more features from a claimed combination can, in some cases, be excised from the combination, and the claimed combination may be directed to a subcombination or variation of a subcombination.

As utilized herein with respect to structural features (e.g., to describe shape, size, orientation, direction, relative position, etc.), the terms "approximately," "about," "substantially," and similar terms are meant to cover minor variations in structure that may result from, for example, the manufacturing or assembly process and are intended to have a broad meaning in harmony with the common and accepted usage by those of ordinary skill in the art to which the subject matter of this disclosure pertains. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above.

What is claimed is:

1. A boresighting mechanism for adjusting an armament of an aircraft, the mechanism comprising:

a housing comprising a proximal end, a distal end, and an inner cavity;

a jackscrew having a threaded portion disposed in the inner cavity and an unthreaded portion extending from the proximal end of the housing;

a follower threadedly coupled to the jackscrew at a first end within the inner cavity and extending from the distal end of the housing, the follower configured to be coupled to an adjustment feature of the armament at a second end; and an adjustment knob coupled to the unthreaded portion of the jackscrew and configured to rotate the jackscrew to thereby cause linear motion of the follower, the linear motion allowing adjustment of the armament via the adjustment feature.

2. The boresighting mechanism of claim 1, wherein:

the inner cavity of the housing comprises knurls spaced closer to the proximal end than the distal end; and the adjustment knob comprises complementary knurls configured to engage with the knurls of the housing, wherein the rotation of the adjustment knob is restricted when the knurls are engaged.

3. The boresighting mechanism of claim 2, wherein:

the complementary knurls of the adjustment knob are configured to engage the knurls of the housing when the armament is not being adjusted and are configured to disengage when the armament is being adjusted.

4. The boresighting mechanism of claim 3, further comprising a spring configured to cause the complementary knurls of the adjustment knob to engage the knurls of the housing when the adjustment knob is maintained proximate to the housing.

5. The boresighting mechanism of claim 4, wherein the spring is configured to push a pin against a slot in the jackscrew to push the adjustment knob toward the housing.

6. The boresighting mechanism of claim 1, wherein the housing comprises a flange configured to be mounted to a mounting surface of the aircraft.

7. The boresighting mechanism of claim 6, wherein the boresighting mechanism is configured to retrofit the aircraft by replacing an existing boresighting mechanism.

8. The boresighting mechanism of claim 1, wherein the housing is integrated into a component of the aircraft.

9. The boresighting mechanism of claim 1, further comprising an adapter coupled to the second end of the follower, the adapter configured to interface with the adjustment feature of the armament.

10. The boresighting mechanism of claim 9, wherein the adapter is a rod end.

11. The boresighting mechanism of claim 1, wherein the threaded portion of the jackscrew comprises acme threads.

12. An aircraft comprising:

an armament rotatably coupled to a surface of a portion of the aircraft and configured to rotate about an axis of rotation;

a mechanism configured to rotate the armament about the axis of rotation, the mechanism comprising:

a jackscrew comprising a threaded portion, the threaded portion threadedly coupled to a follower;

a handle configured to be operated manually, the handle coupled to and configured to rotate the jackscrew; and an adapter coupled to the follower and to the armament, wherein rotation of the jackscrew causes linear motion of the follower and the adapter, the linear motion of the adapter causing the rotation of the armament about the axis of rotation.

13. The aircraft of claim 12, wherein the handle comprises a plurality of knurls configured to restrict the rotation of the jackscrew when the armament is not being adjusted.

14. The aircraft of claim 13, further comprising a spring disposed in an opening of the handle, the spring configured to cause the plurality of knurls to engage to restrict the rotation of the jackscrew when the handle is released.

15. The aircraft of claim 12, wherein the adapter is a rod end.

16. The aircraft of claim 12, wherein the threaded portion of the jackscrew comprises acme threads.

17. A method of boresighting an armament using an adjustment mechanism comprising a handle coupled to a jackscrew disposed within a housing, rotation of the handle causing the jackscrew to adjust a firing angle of the armament, the handle and the housing comprising complementary knurls, the method comprising:

pulling the handle to disengage the knurls of the handle from the knurls of the housing;

rotating the handle to adjust the firing angle of the armament; and releasing the handle to reengage the knurls of the handle with the knurls of the housing.

18. The method of claim 17, further comprising test firing the armament to determine the accuracy of the boresighting.

19. The method of claim 18, further comprising repeating the pulling of the handle, the rotating of the handle, the releasing of the handle and the test firing until the armament is boresighted to within a predefined tolerance.

20. The method of claim 17, wherein the method is performed manually.

* * * * *